United States Patent [19]

Perra, Jr.

[11] Patent Number: 4,559,872

[45] Date of Patent: Dec. 24, 1985

[54] PRINTING APPARATUS USING HEATED INK COMPOSITION

[75] Inventor: Andrew G. Perra, Jr., North Swanzey, N.H.

[73] Assignee: Markem Corporation, Keene, N.H.

[21] Appl. No.: 605,472

[22] Filed: Apr. 30, 1984

[51] Int. Cl.[4] ..... B41F 13/02

[52] U.S. Cl. ..... 101/228; 101/329

[58] Field of Search ..... 118/202; 219/216; 101/25, 8, 219, 216, 228, 329–331, 407 A, 74

[56] References Cited

U.S. PATENT DOCUMENTS

| | | | |
|---|---|---|---|
| 367,886 | 8/1887 | Andrews | 118/202 |
| 1,456,763 | 5/1923 | Chapman et al. | 101/74 |
| 2,018,560 | 10/1935 | Levane . | |
| 2,293,886 | 8/1942 | Bruker . | |
| 2,323,976 | 7/1943 | Chalmers . | |
| 2,468,266 | 4/1949 | Lyons et al. | 118/202 X |
| 2,603,153 | 7/1952 | Warren et al. . | |
| 2,716,379 | 8/1955 | Pitt . | |
| 2,823,605 | 2/1958 | Kutsch . | |
| 3,064,563 | 11/1962 | Cook . | |
| 3,086,461 | 4/1963 | Gill . | |
| 3,229,631 | 1/1966 | Peterson . | |
| 3,255,695 | 6/1966 | Johnson et al. . | |
| 3,294,014 | 12/1966 | Kneisel | 101/25 X |
| 3,412,707 | 11/1968 | West | 118/202 X |
| 3,593,661 | 7/1971 | Tripp . | |
| 3,597,295 | 8/1971 | Tenquist | 118/202 X |
| 3,603,250 | 9/1971 | Knudsen . | |
| 3,731,621 | 5/1973 | Neckel . | |
| 3,736,870 | 6/1973 | Johnson et al. . | |
| 3,965,856 | 6/1976 | Scholl et al. | 118/202 |
| 4,022,124 | 5/1977 | Knudsen . | |
| 4,073,122 | 2/1978 | Areson . | |
| 4,092,920 | 6/1978 | Barnak | 101/407 A X |
| 4,152,986 | 5/1979 | Dadowski et al. . | |
| 4,282,809 | 8/1981 | Stewart . | |
| 4,444,108 | 4/1984 | Jenness, III | 101/44 X |
| 4,475,457 | 10/1984 | Davison . | |

FOREIGN PATENT DOCUMENTS

| | | |
|---|---|---|
| 721302 | 6/1942 | Fed. Rep. of Germany . |
| 648738 | 1/1951 | United Kingdom . |

OTHER PUBLICATIONS

Markem Model 904 Machine Manual (Mar. 1981).
Markem Model 904A Machine Manual (Mar. 1983).
Markem Model 904C+ Machine Manual (Aug. 1983).
Markem Model 997 Machine Manual (Feb. 1983).

*Primary Examiner*—Clifford D. Crowder
*Attorney, Agent, or Firm*—Robbins & Laramie

[57] ABSTRACT

A simple and inexpensive printing apparatus is provided for use with ink compositions of the type which are solid at normal room temperatures and are rendered liquid and flowable at elevated temperatures. The apparatus comprises a rotary printing member having one or more printing elements thereon, an inking roll for inking the printing elements with an ink composition of the type described, and a one-piece, wrap-around radiant heater block for maintaining the inking roll and printing elements at the necessary elevated temperatures. A method for printing with heated ink compositions is also described.

9 Claims, 11 Drawing Figures

PRINTING APPARATUS USING HEATED INK COMPOSITION

BACKGROUND OF THE INVENTION

1. Field of the Invention

The present invention relates generally to a printing apparatus and method, and is particularly concerned with an apparatus and method for printing using an ink composition of the type which is solid at normal room temperature and is rendered liquid or flowable at elevated temperatures.

2. Description of the Prior Art

In many types of product manufacturing and handling operations, particularly food and pharmaceutical packaging, it is necessary to print some type of variable information on the products in addition to the fixed information which appears on pre-printed labels and packaging material. In the case of food and pharmaceutical products, the variable information is very often a date code signifying the date of manufacture or the last date on which the product can be used or sold. The variable information may also consist of a unit price, a lot or batch number, or the like.

Various types of apparatus have been employed for printing date codes and other variable information on products or on the packaging material therefor. This operation is usually referred to as product marking or coding, and the apparatus as a marking or coding device. A typical arrangement consists of a small product marking machine installed as an add-on unit or a conveyor system or other parent machine, the latter carrying either the products themselves or the strip of packaging material which is later cut and applied to the products. It is usually preferred that the marking machine be as simple, reliable and inexpensive as possible. A complex marking apparatus is undesirable from the standpoint of cost and also because it will typically be used and maintained by a product manufacturer who has little or no understanding of its construction or operation. Ink replacement and legend changes, in particular, must be simple to accomplish because these operations may be required very frequently. In the case of date coding, for example, legend changes may be made on a daily basis. Changes in unit prices, lot numbers and batch numbers may be made even more frequently, particularly in manufacturing plants where a number of different types of products are produced. Reliability is important because one wishes to avoid a situation in which a breakdown in the product marking unit forces a temporary shutdown of the entire product manufacturing or packaging operation.

A very useful type of ink composition for product marking applications is one which is solid at normal room temperatures and is rendered liquid or flowable at elevated temperatures. Such an ink composition is kept heated during printing, but it quickly cools and dries after it is applied to the surface to be printed. This makes it possible to handle the printed surface almost immediately without the danger of smearing the printed image. The ink composition is usually impregnated in a cylindrical body of felt or porous plastic foam which serves simultaneously as a supply or reservoir of ink and as an inking or applicator roll for applying the ink to the printing elements. Replacement of the ink supply is accomplished by substituting a new inking roll for the spent or depleted roll. Since the ink composition is solid until it is heated, the spare rolls can be conveniently handled and stored without the risk of ink spillage or mess.

In order to use an ink composition of the type just described, it is essential that the printing or marking device be equipped with means for constantly maintaining the ink in a heated state while it is held on the inking roll as well as after it has been transferred to the printing element. If this is not done, premature cooling and drying of the ink may occur, as for example on the surface of the printing element. This will result in poor print quality. In the past, heating of the inking roll was accomplished in one of two ways. The first method involved heating the shaft on which the inking roll was arranged to rotate, so that heat was delivered to the inking roll by conduction. The second method involved partially enclosing the inking roll in a curved metal heater block with embedded electrical resistance heating devices. This provided a sufficient amount of radiant heat to the inking roll to maintain the ink in a liquid or flowable state. In either case, a separate heating device was required for the printing member in order to prevent cooling and drying of the ink after transfer to the printing elements. This was implemented by means of a separate metal heater block equipped with embedded electrical resistance heating devices and held in contact with the rear faces of the printing elements, the latter usually consisting of metal type. In this way, the printing elements were heated by conduction from the heater block in order to maintain the ink in its liquid or flowable state until contact with the surface to be printed.

Although printing machines constructed along the foregoing lines have proved to be satisfactory for product marking applications, several problems still exist. For example, since the printing elements are heated by conduction from the underlying heater block, the printing elements must be made of a material which is a good conductor of heat but cannot be damaged by direct contact with high temperature surfaces. For all practical purposes, this requires the use of metal type or composite metal-rubber type (e.g., brass-bodied type with rubber typefaces) to the exclusion of less expensive all-rubber type. There is also some difficulty in making electrical connections to the resistance heating devices in the heater block of the printing member, since the latter is almost always a movably mounted component. In cases where the printing member is a cyclically reciprocating arm, rather than a rotary member, direct wire connections can be used as long as there is enough free play in the wires to allow for movement of the arm. In cases where the printing member is of the continuous rotary type, however, direct wire connections cannot be used and one must instead resort to brushes and slip rings or equivalent arrangements. This introduces undesirable complexity and expense into the apparatus as well as additional sources of wear and component failure.

SUMMARY OF THE INVENTION

The present invention provides a novel printing apparatus which avoids the problems and limitations discussed above by utilizing external heating means for both the inking means and the printing member. This eliminates the need to provide electrical connections to the moving printing member and results in a printing apparatus which is simple, reliable and inexpensive to manufacture. In addition, the use of external heating for the printing elements allows less expensive rubber type and other non-metal printing elements to be used in place of metal type.

A printing apparatus in accordance with a preferred form of the present invention comprises a rotary printing member having one or more printing elements thereon, an inking roll for inking said printing elements with an ink composition of the type which is rendered liquid or flowable at elevated temperatures, and unitary radiant heating means at least partially surrounding said rotary printing member and said inking roll for maintaining the printing elements and the inking roll at elevated temperatures. The heating means may comprise a one-piece, substantially U-shaped member made of a thermally conductive material, preferably a metallic material such as aluminum, with one or more electrical heating elements embedded therein. The U-shaped member is preferably positioned with its closed end surrounding the inking roll and its open end at least partially surrounding the rotary printing member, which is preferably in the form of a roll. The U-shaped member may further be provided with cylindrically curved interior surfaces conforming to the peripheral surfaces of the inking and printing rolls. If desired, the printing roll may be provided with a heat retaining core made of a thermally conductive material in order to absorb and re-radiate heat from the U-shaped heating means.

The present invention also comprehends a novel method for printing using an ink composition which is rendered liquid or flowable at elevated temperatures. The method comprises the steps of separately heating both the ink composition and a printing element by means of externally applied radiant heat, applying the heated ink composition to the heated printing element, and then bringing the printing element into contact with a surface to be printed. In cases where the ink composition and the printing element are carried by an inking roll and a rotary printing member, respectively, the steps of applying the ink composition to the printing element and bringing the inked printing element into contact with the surface to be printed are carried out by rotating the printing member to bring the printing element first into contact with the inking roll and then into contact with the surface to be printed.

BRIEF DESCRIPTION OF THE DRAWINGS

The various objects, advantages and novel features of the invention will be more readily apprehended from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
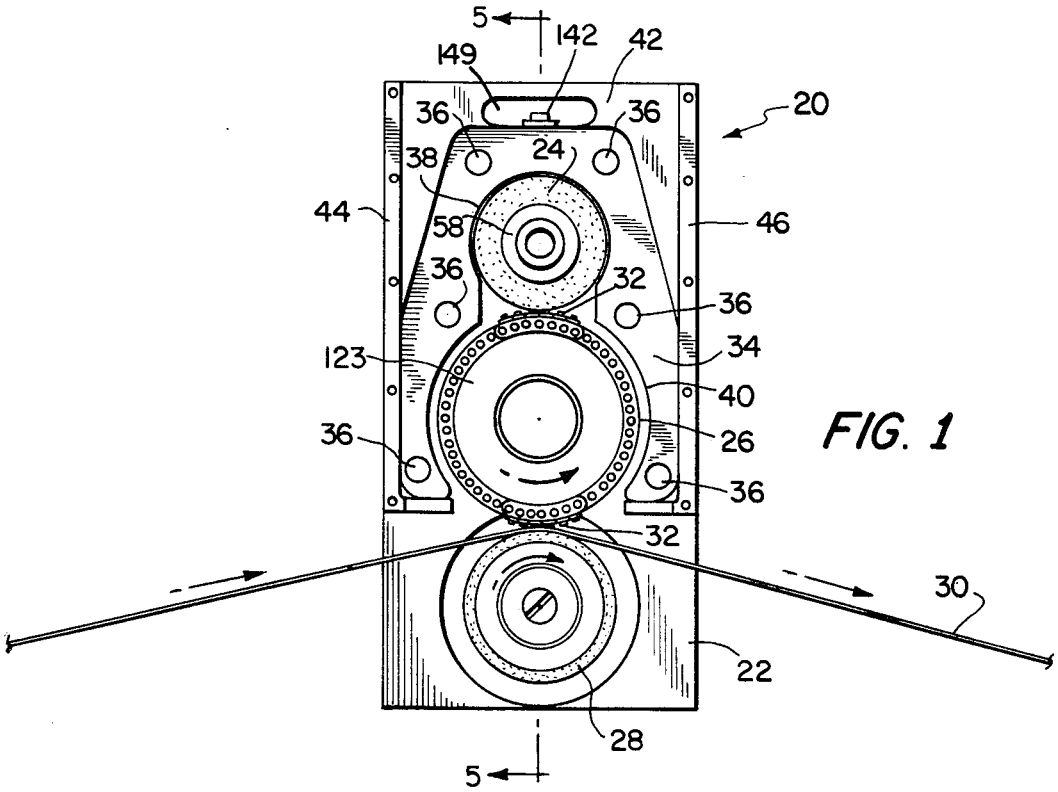
FIG. 1 is a front elevational view of a web-driven printing apparatus in accordance with the present invention.
Figure 2:
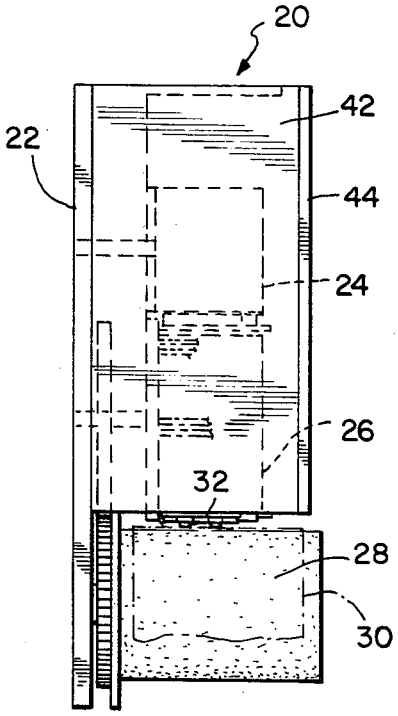
FIG. 2 is a side elevational view of the printing apparatus, with the web shown in phantom.
Figure 3:
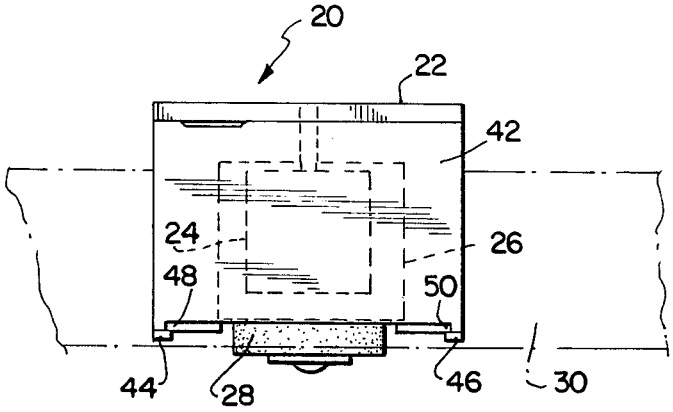
FIG. 3 is a top view of the printing apparatus, also showing the web in phantom.

FIGS. 1–3 are front, side and top views, respectively, of a web-driven printing apparatus 20 constructed in accordance with the principles of the present invention. The printing apparatus 20 includes a metal back plate 22 which serves simultaneously as a supporting frame and rear cover for the apparatus. Attached to the back plate 22 are shafts for an inking roll 24, a printing roll 26, and a backup or pressure roll 28. In the illustrated embodiment, the backup roll 28 is driven by the web 30 to be printed, and the printing roll 26 is driven by a gear connection to the backup roll 28. The inking roll 24 is free-turning on its shaft and is rotated by intermittent contact with the printing elements 32 of the printing roll 26.

The inking roll 24 comprises a cylindrical body of porous plastic foam which is impregnated with a "hot-melt" ink composition consisting of a pigmented thermoplastic material. An ink composition of this type is solid at normal room temperature but is rendered liquid and flowable when subjected to elevated temperatures of about 250°–300° F. Such an ink composition is available in plastic foam rolls (Part No. 8000300) from the assignee of this invention, Markem Corporation, of Keene, N.H., under the brand names TOUCH-DRY and TOUCH-DRY PLUS. At normal room temperatures, the inking roll 24 has a hard, solid consistency and will not release any ink. This allows for clean replacement of spent or depleted ink supply rolls. When heated to its operating temperature, however, the ink composition becomes fluid and readily transfers to the printing elements 32 on the printing roll 26. The inking roll 24 is impregnated with the ink composition only down to a certain depth, leaving a non-impregnated area 25 of resilient foam (visible in FIG. 4) into which a plastic hub 58 can be inserted as will be described shortly.

In accordance with an important feature of the present invention, a one-piece, wrap-around radiant heater block 34 is provided around the inking roll 24 and the printing roll 26. The heater block 34 is preferably provided in the form of a milled or cast aluminum member substantially in the shape of an inverted "U", as shown. The U-shaped member has its closed end surrounding the inking roll 24 and its open end partially surrounding the printing roll 26. Holes 36 are provided at spaced locations in the heater block 34 to accommodate a number of electrical resistance heating elements, the latter serving to raise the temperature of the heater block 34 and thereby radiate heat to the inking roll 24 and the printing roll 26. The heater block 34 may be made of any suitable thermally conducting material, but it is preferably made of a metallic material such as aluminum, as already noted. In order to provide for efficient and uniform heating at the surfaces of the inking roll 24 and printing roll 26, the heater block 34 is preferably provided with cylindrically curved interior surfaces 38, 40 which conform closely to the peripheral surfaces of these rolls.

An outer case 42 made of a suitable heat-resistant plastic material, such as the plastic materials marketed under the brand names NYLON 101 and VALOX, is provided over the heater block 34 in order to prevent injury to personnel and also to provide a housing for the printing apparatus 20. The forward edges of the case 42 are fitted with bars or rails 44, 46 which define channels 48, 50 for receiving a sliding front cover 52 (visible in FIG. 4).

Figure 4:
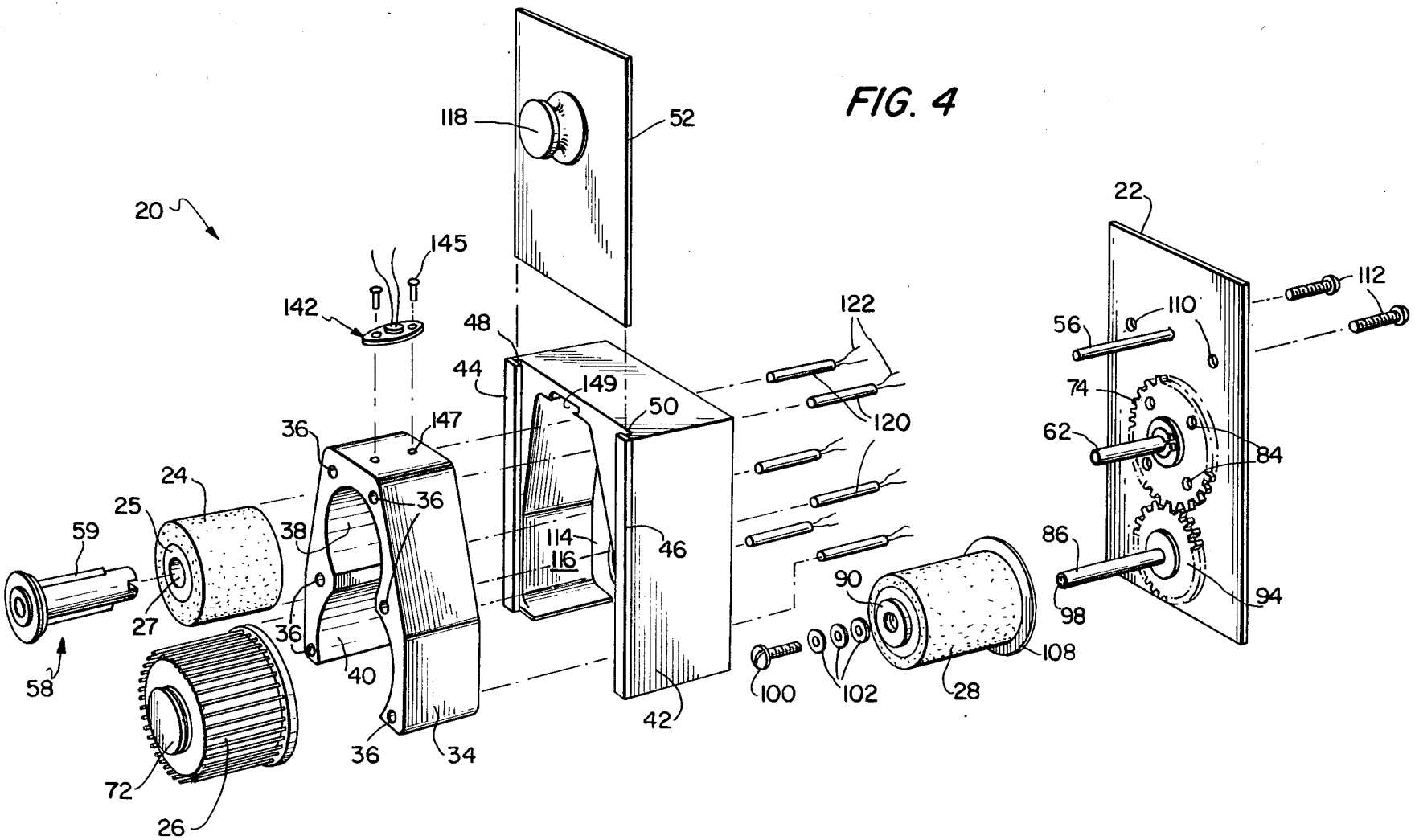
FIG. 4 is an exploded view of the printing apparatus.
Figure 5:
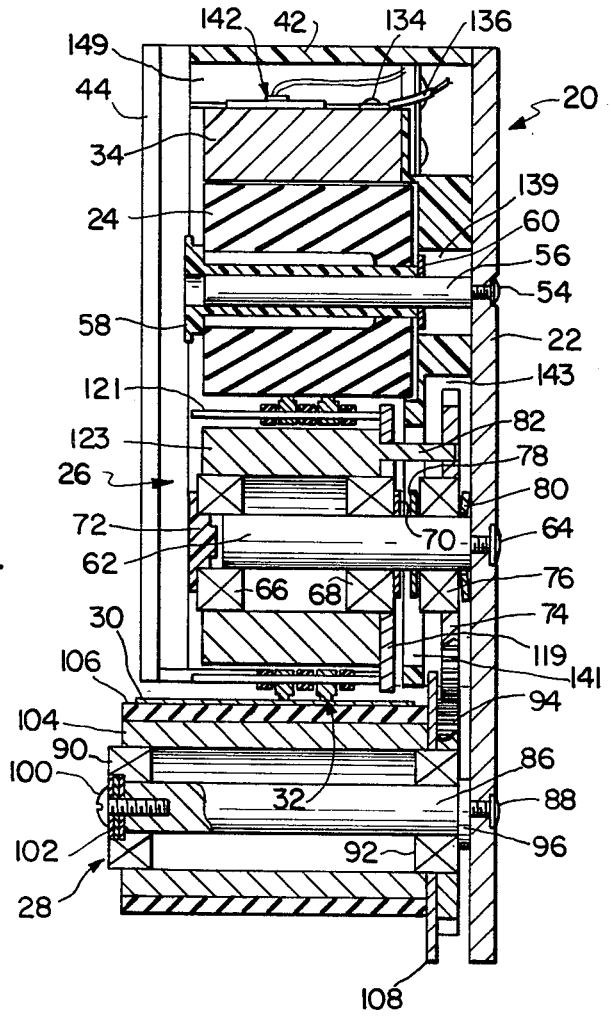
FIG. 5 is a sectional view of the printing apparatus, taken along the line 5—5 in FIG. 1.

Further details of the printing apparatus 20 can be seen in the exploded view of FIG. 4 and in the sectional view of FIG. 5, the latter taken along the line 5—5 in FIG. 1. Affixed to the upper part of the back plate 22 by a screw 54 is a first shaft 56 for supporting the inking roll 24. This shaft is fixed (i.e., non-rotatable) relative to the back plate 22. The inking roll 24 is formed with a central or axial hole 27 in which a plastic hub 58 is tightly fitted. The hub 58 is formed with vanes or grips 59 which allow the hub to engage the resilient central area 25 of the inking roll 24 surrounding the hole 27. The hub 58 has a loose running fit over the shaft 56 in order to allow the roll 24 to turn freely thereon. The hub 58 protrudes slightly from the rear of the inking roll 24 and contacts a grip ring 60 which is fitted on the shaft 56. The grip ring 60 acts as a stop for limiting rearward axial movement of the inking roll 24, thereby preventing the roll 24 from rubbing against the rear wall of the housing 42. Forward movement of the inking roll 24 off the shaft 56 is prevented by the sliding cover 52 when the latter is in place on the front of the housing 42.

A second fixed shaft 62 is attached to the back plate 22 by means of a screw 64 in order to support the printing roll 26. The printing roll 26 is rotatably mounted on the shaft 62 by means of a pair of radial ball bearing units 66 and 68. A grip ring 70 is fitted to the shaft 62 to serve as a stop for limiting rearward movement of the printing roll 26, thereby preventing rubbing contact between the printing roll and the rear wall of the housing 42. A plastic end cap 72 holds the printing roll 26 on the shaft 62 and serves as a spacer with respect to the front cover 52 when the latter is in place on the front of the housing 42. In order to cause the printing roll 26 to rotate in synchronism with the backup roll 28, a gear 74 is rotatably mounted on the printing roll shaft 62 by means of a radial ball bearing unit 76. Grip ring 78 and spacer 80 are fitted to the shaft 62 on opposite sides of the bearing 76 in order to fix the position of the gear 74 on the shaft 62 and provide a spacing with respect to the back plate 22. The printing roll 26 includes a rearwardly projecting drive rod 82 which is removably received in one of several holes 84 formed in the gear 74. By virtue of this arrangement, the printing roll 26 is driven by the gear 74 as both rotate about the fixed shaft 62.

When it is desired to change or clean the printing elements, the printing roll 26 and the attached bearings 66, 68 can be removed from the shaft 62 by a simple sliding motion which disengages the drive rod 82 from the particular one of the holes 84 in which it was received. The process is reversed when it is desired to re-install the printing roll 26. Although a single hole 84 would suffice for engaging the drive rod 82, several are provided in order to facilitate re-installation of the printing roll 26 without repeated rotational adjustment of the printing roll relative to the gear 74. However, if it is desired to maintain printing registration between the printing elements 32 and pre-selected positions on the web 30, only one hole 84 should be provided so that the printing roll 26 will have only one possible rotational position with respect to the gear 74 after the printing roll is re-installed.

A third fixed shaft 86 is affixed to the lower portion of the back plate 22 by a screw 88 for supporting the backup or pressure roll 28. A pair of radial ball bearing units 90, 92 serves to rotatably mount the backup roll on the shaft 86 in order to allow the backup roll to turn freely thereon. A flange or disk 108 and gear 94 are fastened to the rear part of the backup roll 28 and overlie a portion of the rear bearing 92. A spacer 96 is placed between the inner race of the rear bearing 92 and the back plate 22 in order to maintain a spacing between the back plate and the gear 94. The forward end of the shaft 86 is provided with a tapped hole 98 for receiving a mounting screw 100. The screw 100 is installed in the tapped hole 98 with a number of washers 102, the latter making contact with the inner race of the forward bearing 90 in order to hold the backup roll 28 on the shaft 86.

In operation, the movement of the web 30 to be printed causes rotation of the backup roll 28 and the attached gear 94. The gear 94 in turn rotates the upper gear 74 and the printing roll 26. The ratio of the gears 74 and 94 is chosen in proportion to the relative diameters of the printing roll 26 and backup roll 28, in order to insure that the peripheral velocity of the printing elements 32 is the same as that of the surface of the backup roll 28 at the nip where the web 30 is engaged. The backup roll 28 includes a metal core 104 and a peripheral surface layer 106 made of rubber or some other suitable resilient material. The resilient layer 106 provides frictional engagement with web 30 to be printed and thereby insures that the web movement is reliably transmitted by the backup roll 28 and the gears 74, 94 to the printing roll 26.

The flange or disk 108 affixed to the inner end of the backup roll 28 prevents contact between the inner edge of the web 30 and the area where the gears 74 and 94 mesh. The gear 94 and flange 108 may be removable from the backup roll 28 to allow for removal and reverse mounting of the backup roll in cases where the resilient layer 106 experiences uneven side-to-side wear. Alternatively, flanges may be permanently affixed at both ends of the backup roll 28 so that they need not be removed when the backup roll is to be reversed.

Referring particularly to FIG. 4, the metal back plate 22 of the printing apparatus 20 is provided with holes 110 for receiving a pair of screws 112. The screws 112 pass loosely through the holes 110 and through similar holes 111 (visible in FIG. 7) in the rear wall 114 of the housing 42. The threaded portions of the screws 112 are engaged with tapped holes (not shown) formed in the rear part of the heater block 34. The heater block 34 is thereby held in place within the housing 42 and the latter is held in place by virtue of having its rear wall 114 clamped between the heater block and the back plate 22. The housing 42 is formed with an internal cavity 116 conforming to the outside shape of the heater block 34 in order to lock the heater block in the proper position with respect to the printing roll 26 and the inking roll 24.

If desired, the screws 112 may be made to engage tapped holes in the plastic housing 42 rather than engaging the heater block 34 directly. This would avoid heat loss from the heater block 34 to the metal back plate 22 through the screws 112. In order to hold the heater block 34 in place in this alternative method of construction, the plastic housing 42 may be formed in two parts with the heater block 34 retained or captured between the two parts.

The inking roll 24, printing roll 26 and backup roll 28 are mounted on their respective shafts 56, 62 and 86 in the manner already described. The cover 52, which may be made of the same material as the housing 42, slides downward in the channels 48, 50 formed by the rails 44, 46 in order to provide a front closure for the printing apparatus 20. A knob or handle 118 is provided on the front cover 52 in order to allow the cover to be conveniently opened and closed when it is necessary to replace the inking roll 24 or to clean or change the printing elements 32 on the printing roll 26.

Figure 6:
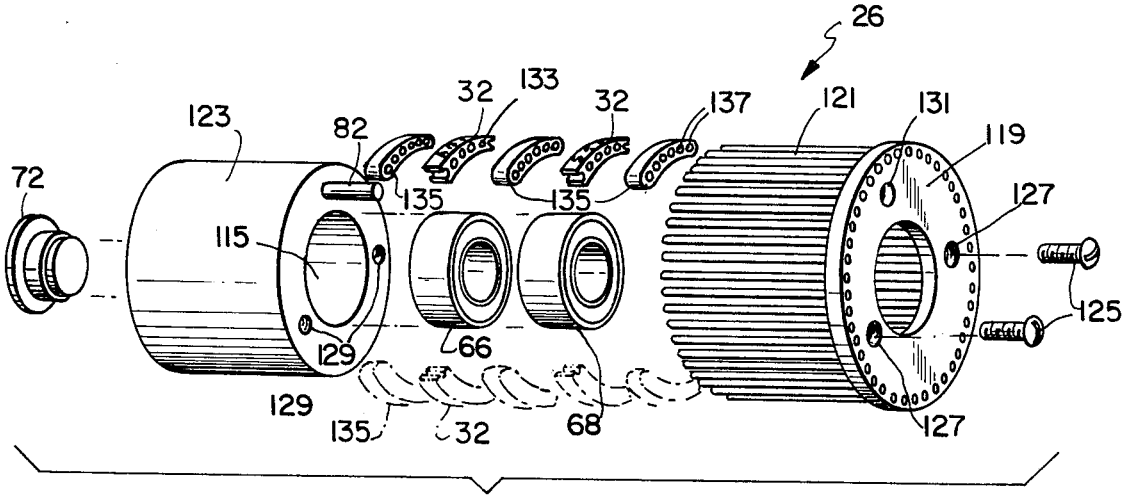
FIG. 6 is an exploded view of the printing roll used in the printing apparatus of the previous Figures.

The detailed construction of the printing roll 26 is illustrated in FIG. 6. The printing roll has a two-part construction comprising a disk 119 with a number of type-holding ribs or pins 121 affixed thereto and a central core 123. The central core 123 is cylindrical in shape with an axial hole 115 for receiving the bearings 66 and 68. The core 123 is made of a heat retaining material such as aluminum in order to absorb and reradiate heat from the heater block 34. The core 123 is fastened to the disk 119 interiorly of the pins 121 by means of a pair of screws 125, the latter passing through holes 127 in the disk 119 and being received in a corresponding pair of tapped holes 129 formed in the core 123. The drive pin 82 is affixed to the core 123 and projects through a hole 131 in the disk 119 so that it can engage one of the holes 84 in the printing roll drive gear 74 as illustrated in FIG. 5. Printing elements 32 are provided in the form of slugs or lines of type with holes 133 which are dimensioned to fit over the pins 121 held by the disk 119. The printing elements may be made of metal or rubber, or a combination thereof (e.g., brass-bodied rubber type), and may comprise single characters as well as one or more lines of type. Rubber type stops 135 with similar holes 137 are used to hold the printing elements 32 in position on the pins 121 and to provide a spacing between adjacent lines of type if desired. Larger printing dies or plates made of metal, rubber or plastic may also be affixed to the pins 121 in place of or in addition to individual type elements or lines of type. One, two or a greater number of groups of printing elements 32 may be provided on the printing roll 26 depending upon the desired repeat length between successive printed indicia on the web 30. In the illustrated embodiment, two groups of printing elements spaced 180° apart are shown.

When it is desired to change the legend being printed, the printing roll 26 is removed from the shaft 62 of FIG. 5 and the printing elements 32 and type stops 135 are slipped off the pins 121. New type characters, lines of type, die plates, or combinations of these may then be slipped on the pins and the stops 135 replaced. This procedure does not require that the core 123 be separated from the disk 119, and for that reason, the core 123 and disk 119 may be formed in one piece if desired.

Electric resistant heating elements 120 (shown in FIG. 4) are disposed in the holes 36 formed in the heater block 34. The resistance heating elements 120 are metal-encased devices which heat the heater block 34 internally by conduction. The heating elements are snugly received in the holes 36 but are preferably not permanently bonded therein in order to allow for the possibility of removal and replacement of the elements in the event of failure. The holes 36 are formed completely through to the rear face of the heater block 34 to permit such removal and also to allow the electrical wires 122 leading to the heating elements 120 to be run through the area between the back plate 22 and the rear wall 114 of the housing 42. In the event that one of the heating elements 120 becomes lodged or jammed within its corresponding hole 36, a rod or other tool may be introduced through the forward opening of the hole 36 to cause the heating element to be pushed out through the rear opening of the hole.

The electrical current to the heating elements 120 is controlled by a thermostat 142 which is in thermal contact with the heater block 34. As illustrated in FIG. 4, the thermostat 142 is affixed to the top of the heater block 34 by means of screws 145 which engage tapped holes 147 formed in the heater block. An upper cavity 149 in the housing 42 provides a clearance to accommodate the thermostat 142. A thermostat of the type described is available from Fenwal Electronics of Framingham, Mass.

Figure 7:
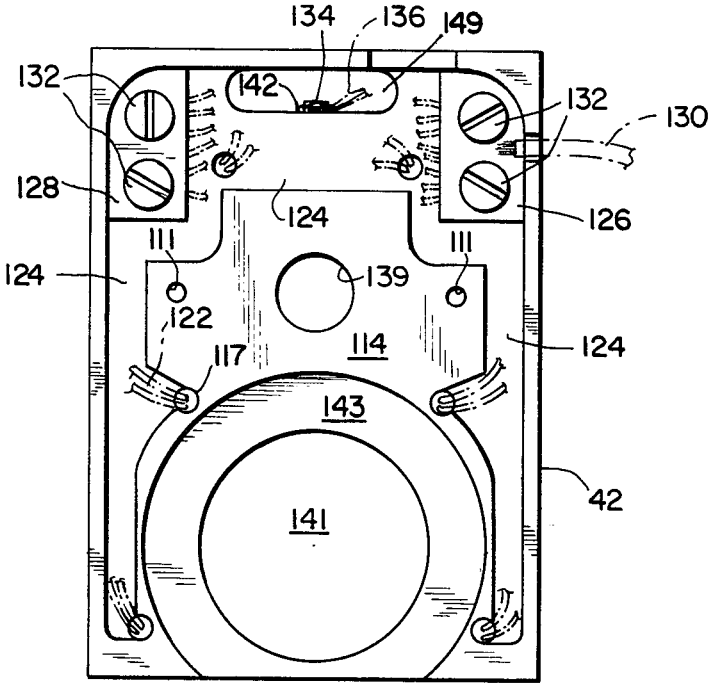
FIG. 7 is a rear elevational view of the housing of the printing apparatus with the back plate and rolls removed.

As can be seen in the rear view of FIG. 7, in which the back plate 22 and rolls 24, 26, 28 have been removed, the side of the rear wall 114 which faces the back plate is formed with holes 117 corresponding to the holes 36 in the heater block 34 and with channels 124 for receiving the wires 122 leading to the heating elements 120. The wires 122 lead to metal terminal strips 126, 128 which are connected to a source of electrical power through a power cord 130. The metal strips 126, 128 are attached to the housing 42 by means of screws 132 and serve as clamps for the bare ends of the wires 122. If desired, the metal strips 126, 128 may be replaced with a conventional terminal strip of the type in which the wire ends are individually held by metal screws mounted on a plastic insulating base. As a precaution, a grounding screw 134 (also visible in FIG. 5) is threaded into a tapped hole at the top of the heater block 34 and a grounding wire 136 is connected between the screw 134 and an electrical grounding point. This insures against a possible electrical hazard in the event that one or more of the metal-encased heating elements 120 develops an internal short circuit that results in an unsafe voltage being applied to the heater block 34.

Figure 8:
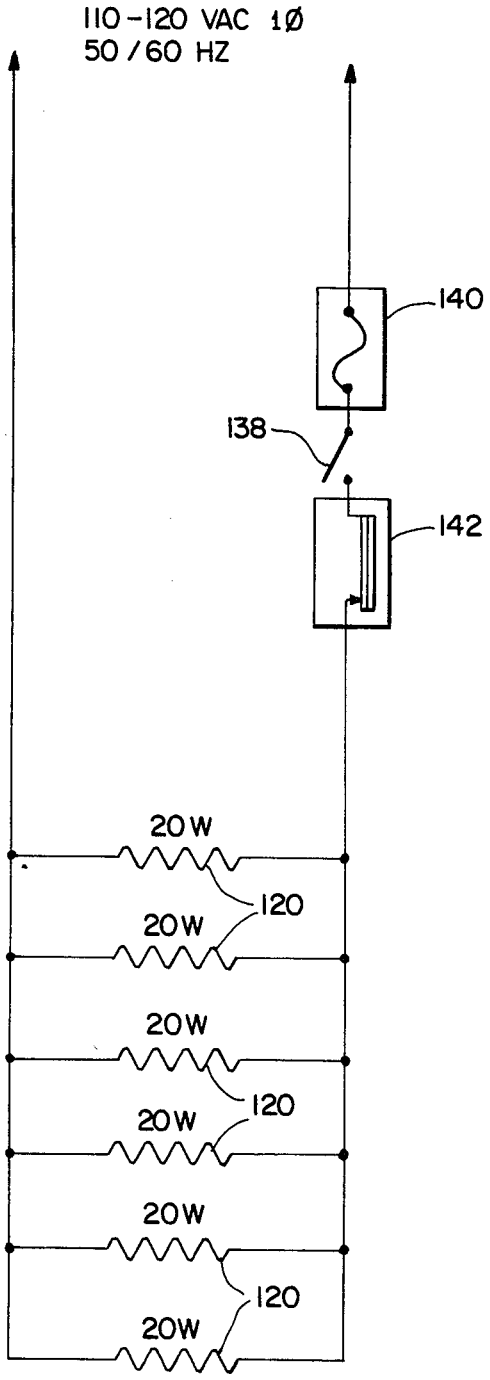
FIG. 8 is a schematic diagram of the electrical circuit for the resistance heating element used in the printing apparatus.

FIG. 8 is a schematic diagram of the electrical circuit for the resistance heating elements 120. Six cartridge-type heating elements are employed, one being received in each of the holes 36 in FIGS. 1 and 4. Each heating element is a 110–120 volt, 20-watt device which operates from a single-phase A.C. source. Heating elements of this type are available from Hotwatt, Inc. of Danvers, Mass. All six devices are connected in parallel across the incoming A.C. line. A single-pole, single-throw switch 138 controls the power to the heating elements by opening or closing one side of the A.C. line. A fuse 140 is provided on one side of the A.C. line to protect against excess currents due to short circuits, defective heating elements, and the like. The thermostat 142, described previously, senses the temperature of the heater block 34 and opens and closes one side of the A.C. line to maintain the heater block 34 at a uniform temperature, preferably in the range of 300°–350° F. In place of the thermostat 142, a solid-state thermistor may be employed together with appropriate sensing and control circuitry to regulate the current flow to the heating elements 120. The thermistor may be received in a hole formed in the heater block 34, similar to the holes 36 used for the heating elements 120.

Figure 9:
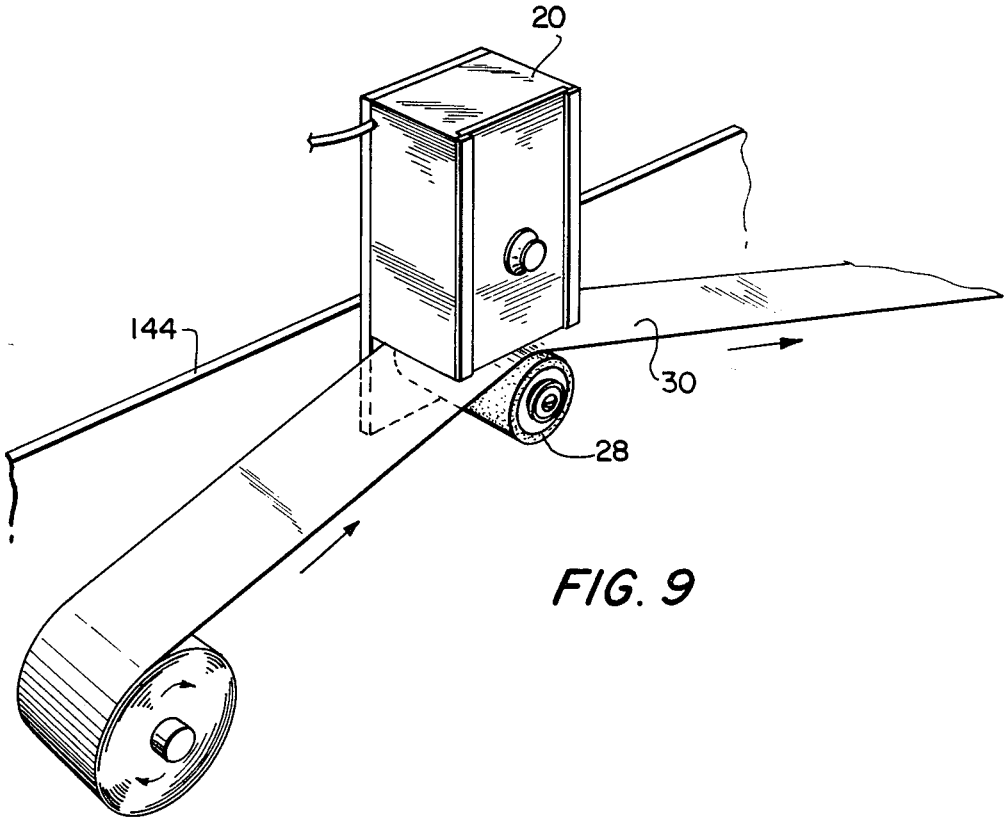
FIG. 9 is a perspective view of the printing apparatus of the previous Figures installed on a parent machine.

The operation of the printing apparatus 20 will be apparent from the foregoing description but will be explained briefly. As illustrated in FIG. 9, the printing apparatus 20 is mounted on a parent machine 144 which may, for example, be a wrapping machine utilizing a web 30 of wrapping material on which date codes or other legends are to be printed. Alternatively, the parent machine may be a tape sealer that is used to seal shipping cartons, with the legends (e.g., packing or shipping date) being printed on the tape web 30. In still another application, the web 30 may comprise a strip of developed photographic film on which date codes are to be printed. In all cases, it is to be understood that the web 30 is moved by the parent machine in the direction indicated by the arrows in FIG. 9. This motion causes the backup roll 28 to rotate in a clockwise direction. As indicated in FIGS. 1 and 9, it is preferred that the web 30 be made to "wrap" somewhat around the backup roll 28 in order to provide a large area of contact with the surface thereof. This insures that there will be adequate frictional engagement between the web 30 and the resilient surface of the backup roll 28 to cause the backup roll to be rotated by the moving web.

Referring now to FIGS. 1 and 5 in particular, clockwise rotation of the backup roll 28 is transmitted by the gears 94 and 74 to the printing roll 26, causing the latter to turn in a counter-clockwise direction. Continuous rotation of the printing roll 26 causes the printing elements 32 to alternately contact the heated inking roll 24, which applies ink to the printing elements, and then the web 30, to which the inked image is transferred. The resilient surface of the backup roll 28, in addition to enhancing frictional engagement with the web 30, also provides a yielding backup surface to absorb the pressure exerted by the printing elements 32 at the nip between the printing and backup rolls.

The heater block 34 is maintained at a uniform temperature in the range of 300°–350° F. during printing in order to supply radiant heat to the inking roller 24 and to the printing elements 32 on the printing roller 26. The heat applied to the inking roller 24 raises the temperature of the ink composition therein by an amount sufficient to render the ink liquid or flowable, thereby allowing the ink to transfer to the printing elements 32. The heat applied to the printing elements 32 maintains these at a somewhat lower temperature (about 270°–300° F.), which is enough to insure that the ink composition deposited on the printing elements remains in its liquid or flowable state until it is transferred to the web 30. Once applied to the web 30, the ink composition quickly cools and dries (i.e., solidifies), allowing the printed image to be handled almost immediately without the danger of smearing.

Since the printing elements 32 on the printing roll 26 are heated externally by radiant heat, the printing elements need not comprise metal type but may instead comprise less expensive rubber type. In addition to its cost advantages, rubber type conforms to uneven surfaces more readily than metal type and also carries more ink, resulting in printed images with greater opacity. Plastic printing elements such as etched plastic printing plates may also be used.

The cylindrically curved interior surfaces 38, 40 in the heater block 34 conform closely and evenly to the surfaces of the inking and printing rolls and allow these rolls to be heated uniformly and efficiently by the heater block 34. The metal core 123 of the printing roll 26 also assists in the heating process by retaining and re-radiating heat absorbed from the heater block 34. The re-radiated heat is provided principally to the printing elements 32. This helps to offset the slight momentary cooling that takes place when the printing elements move to the lowermost position, where they contact the much cooler web and are not receiving heat directly from the heater block 34. The supplemental heating effect of the core 123 is most advantageous when the printing elements 32 comprise metal type elements, since these can be heated directly by conduction if they are in contact with the core.

In addition to providing supplemental heating for the printing elements 32, the core 123 of the printing roll 26 also promotes uniform heating of the inking roll 24. As will be evident from FIG. 1, the core 123 effectively closes off the open portion of the inverted U-shaped heater block 34 and provides additional heating for the portion of the inking roll 24 which is not within the cylindrically curved area 38.

Figure 10:
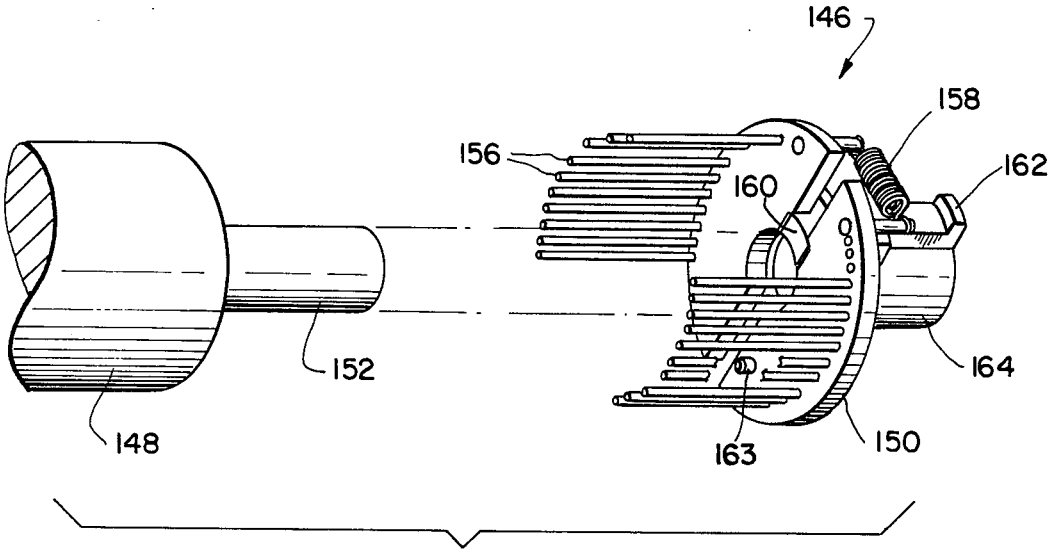
FIG. 10 is an exploded view of an alternative type of printing roll which may be employed in the present invention.

FIG. 10 illustrates an alternative type of printing roll 146 which may be employed in connection with the printing apparatus 20. The core 148 in this embodiment is a permanent (i.e., non-removable) part of the printing apparatus and is provided with an extended shaft 152. The disk 150 of the printing roll 146 is separable from the core 148 and is in two halves, each half being provided with a plurality of pins 156 for receiving printing elements (not shown) in the manner described previously. The two halves of the disk 150 are held together by a spring 158 but can be pivotally separated somewhat by the upward movement of a separating member 160. Such movement of the separating member 160 is caused by depressing a lever 162 mounted on the plastic handle 164 of the disk 150. Separation of the two halves of the disk 150 releases the grip between the rear faces of the printing elements and the outer surface of the core 148, allowing the disk 150 and the attached pins 156 to be removed from the core 148 and shaft 152 for legend changes or cleaning. When the printing roll 146 is re-installed, the separating member 160 engages a notch (not shown) on the shaft 152 to hold the printing roll in place. In addition, a pin 163 on the disk 150 engages a hole (not shown) formed in the end face of the core 148 to fix the rotational position of the printing roll. One advantage of the printing roll 146 of FIG. 10 is that a handle 164 is provided to facilitate removal of the printing elements without requiring operator contact with the pins 156 or disk 150, which become hot when the printing apparatus 20 is in operation. Another advantage is that the core 148, which also becomes hot, is not removed in this embodiment.

Figure 11:
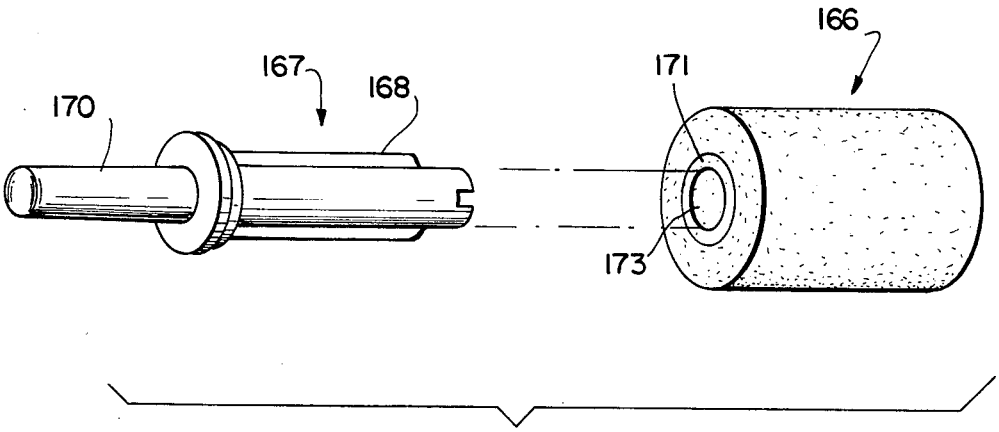
FIG. 11 is an exploded view of an alternative type of inking roll which may be employed in the present invention.

FIG. 11 illustrates a modified inking roll assembly which can be employed in the printing apparatus 20. The plastic hub 167 of the inking roll 166 includes a projecting handle 170 which allows the roll to be conveniently and safely removed from the printing apparatus when the supply of ink in the roll has been depleted, avoiding the need for operator contact with the heated surfaces of the roll. As in the earlier embodiment, the hub 167 is fitted with raised vanes or grips 168 for engaging the resilient, non-impregnated area of plastic foam 171 in the central part of the inking roll 166 surrounding the hole 173.

In order to accommodate the modified printing on inking rolls of FIGS. 10 and 11, the front cover 52 of the printing apparatus may be modified to provide slots or cut-outs for the handles of these rolls. A hinged or pivoted front cover may also be used. Alternatively, a swing-away cover may be provided only for the inking roll so that the printing roll is left more accessible for legend changes, cleaning and the like.

In practice, a separate preheater may be employed for heating spare printing and inking rolls which are to be installed on the printing apparatus 20. This avoids the warm-up period that is normally necessary when a new printing or inking roll is put into use.

The drive system for the printing apparatus 20 can take several forms and need not be as described. For example, the printing roll 26 can be driven from the backup roll 28 by a friction drive connection, such as a rubber O-ring, in place of the gears 74 and 94. Alternatively, the printing roll 26 can be shaft-driven by means of a direct connection to the parent machine. In that case, a clutch can be provided on the drive shaft to control the positions of the printed indicia on the moving web.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. All such substitutions and modifications are intended to fall within the scope of the invention as defined in the appended claims.

What is claimed is:

1. A printing apparatus comprising:

a rotating printing member having at least one printing element thereon;

an inking roll for inking the printing element, said inking roll having a porous construction and being impregnated with an ink composition of the type which is solid at normal room temperatures and is rendered liquid or flowable at elevated temperatures; and radiant heating means for maintaining the inking roll and the printing element on the printing member at elevated temperatures, said radiant heating means comprising a one-piece, substantially U-shaped member made of a solid block of thermally conductive material with one or more electrical heating elements therein, said U-shaped member having its closed end surrounding the inking roll and its open end partially surrounding the printing member.

2. A printing apparatus as claimed in claim 1, wherein the U-shaped member is provided with first and second cylindrically curved interior surfaces which conform closely to the outermost surfaces of the inking roll and printing member, respectively.

3. A printing apparatus as claimed in claim 1, wherein said thermally conductive material comprises a metallic material.

4. A printing apparatus as claimed in claim 1, wherein said thermally conductive material comprises aluminum.

5. A printing apparatus as claimed in claim 1, wherein the printing member includes a heat retaining core made of a thermally conductive material for absorbing and re-radiating heat from said U-shaped member.

6. A printing apparatus as claimed in claim 1, further comprising a backup roll for supporting a web to be printed in rolling contact with the printing member.

7. A printing apparatus as claimed in claim 6, wherein at least one of said backup roll and said printing member are rotatably driven by the web.

8. A printing apparatus as claimed in claim 7, wherein the backup roll and the printing member are affixed to first and second gears, respectively, said first and second gears being in meshing connection in order to cause the backup roll and printing member to rotate in synchronism.

9. A printing apparatus as claimed in claim 8, wherein the backup roll is provided with a resilient surface in order to frictionally engage the web.

* * * * *